US005439772A

United States Patent [19]

Takagi et al.

[11] Patent Number: 5,439,772

[45] Date of Patent: Aug. 8, 1995

[54] MAGNETIC TONER AND PROCESS FOR PRODUCING THE SAME

[75] Inventors: Seiichi Takagi; Toyofumi Inoue; Ikutaroh Nagatsuka, all of Minami Ashigara, Japan

[73] Assignee: Fuji Xerox Co., Ltd., Tokyo, Japan

[21] Appl. No.: 216,338

[22] Filed: Mar. 23, 1994

[30] Foreign Application Priority Data

Mar. 26, 1993 [JP] Japan ..... 5-090566
Feb. 17, 1994 [JP] Japan ..... 6-041810

[51] Int. Cl.[6] ..... G03G 7/083

[52] U.S. Cl. ..... 430/106.6; 430/110; 430/111; 430/137

[58] Field of Search ..... 430/106.6, 110, 137, 430/111

[56] References Cited

U.S. PATENT DOCUMENTS 4,849,316 7/1989 Kawaski et al. .
5,252,421 10/1993 Ichimura et al. ..... 430/110
5,270,143 12/1993 Tomiyama et al. ..... 430/109
5,298,354 3/1994 Matsunaga et al. ..... 430/110

FOREIGN PATENT DOCUMENTS 2-251968 10/1990 Japan .
4-166850 6/1992 Japan .

*Primary Examiner*—Christopher D. Rodee
*Attorney, Agent, or Firm*—Oliff & Berridge

[57] ABSTRACT

A magnetic toner comprising a binder resin, a magnetic substance, and polyolefin fine particles, wherein the content of the magnetic substance is from 20 to 80% by weight, the polyolefin fine particles have a mean dispersed particle diameter of from 0.01 to 0.5 μm, the content of the polyolefin fine particles is from 2 to 20% by weight, and the toner particles have a residual magnetization ($\sigma_r$) of from 4 to 7.0 emu/g. The magnetic toner has suitability both to printing and to reading with an MICR.

20 Claims, No Drawings

MAGNETIC TONER AND PROCESS FOR PRODUCING THE SAME

FIELD OF THE INVENTION

This invention relates to a magnetic toner for development of an electrostatic latent image which is particularly suited to a reading system using a magnetic ink character reader (hereinafter abbreviated as MICR). More particularly, it relates to a magnetic toner providing a toner image which, after being fixed, can be repeatedly read out with a magnetic head or the like.

BACKGROUND OF THE INVENTION

Dry development processes now adopted in various electrostatic copying machines include a two-component development process using a toner and a carrier, e.g., iron powder, and a one-component development process using no carrier.

The developing machine to be used in the one-component development process is more compact than that for the two-component development process because the former requires no automatic concentration controller as is required in the latter. Additionally, the former involves no contamination of a carrier so that such maintenance operation as carrier exchange is not needed. On account of these advantages, the one-component development process has extending its application over not only low-speed small-sized copying machines or printers but medium- or high-speed copying machines or printers, and there has been a demand for further improved performance.

On the other hand, attempts have been made to utilize the one-component development process using a one-component magnetic toner in easily preparing papers which can be read with a magnetic ink character reader (MICR), such as personal checks. This system is generally called an MICR system.

The MICR system is a system comprising reading a magnetized image with a magnetic head. Because the magnetic image is usually printed with a liquid magnetic ink, image formation is not easy. While a printing system using the aforesaid two-component development process has also been put to practical use, this system requires a large-sized printing machine and is still uneasy.

Application of a one-component development process using a magnetic toner to the MICR system is therefore expected to achieve increased efficiency in image formation on account of the compactness of the machine to be used and the simplicity of maintenance.

However, application of the conventional one-component development process to the MICR system involves a problem that the magnetic toner image has too weak magnetization to be read correctly with an MICR. Besides, the reader for the MICR system is designed so as to read an image printed with a liquid ink. Unlike an image formed of a liquid ink, a magnetic toner image heat-fixed on paper or any other image support does not infiltrate into the support and is apt to fall off the support. The toner separated from the support tends to contaminate the magnetic head, which causes erroneous reading.

The magnetic toner which can be applied to an MICR system should meet both suitability to an MICR and suitability to a printer. More specifically, the magnetic toner should provide a toner image having sufficient magnetization enough to be read with a magnetic head; the toner should not cause untoward problems through repeated friction with a magnetic head; the toner should be adaptable to a conventional one-component magnetic toner electrophotographic system; and the printed toner image should have image quality at least equal to that obtained in a conventional electrophotographic printing system.

In order to obtain sufficient magnetization for reading with a magnetic head, a toner coverage (toner amount) per image may be increased to enhance magnetization of the toner image. In this case, however, the toner image will be collapsed due to too much toner, or the toner will be scattered around the image (blur), resulting in a failure of correct reading. In addition, as the toner pile height increases, the toner is easily scraped by a magnetic head.

As another approach to increased magnetic force of a toner image, the content of a magnetic substance in toner particles may be increased. However, this method leads to deterioration of tribological properties of the toner, causing reductions in image quality, such as sharpness, especially in a high temperature and high humidity environment, transfer properties, image stability, fixing properties, and strength of the toner itself. It would follow that the toner image is apt to be scraped with an MICR, failing to be read out.

Therefore, the above-mentioned approaches for obtaining increased magnetization, i.e., to increase the toner coverage per image or to increase the magnetic substance content, are not deemed to be effective solutions.

On the other hand, JP-A-4-166850 (the term "JP-A" as used herein means an "unexamined published Japanese patent application") proposes a toner for an MICR system which has a magnetic substance content of not more than 50%, a coercive force of from 145 to 200 Oe, and a residual magnetization of from 3.0 to 5.5 emu/g. Although the magnetic toner proposed shows sufficient magnetization for an MICR, various disadvantages were revealed on repeated friction with a magnetic head in actual application to an MICR system, such as image staining (smears), magnetic head contamination (foil contamination), and an increase of errors in reading (reject rate). In addition, image durability (image wear), an important requirement for application to an MICR system, was insufficient for practical use. In particular, where a needle-shaped magnetic substance is used merely for assuring high magnetic force, such magnetic substance has poor dispersibility because of the small bulk density.

In order to solve the problems of toner fall-off and magnetic head contamination with the separated toner in the MICR system, a few proposals have been made to date. For example, it has been suggested to incorporate a polyolefin into toner particles to provide a toner which can be used in a medium- to high-speed double-side copying machine, which has recently be developed for resources saving. Incorporation of a polyolefin into toner particles aims at improvements of slip properties and anti-smudge properties of a toner image ("smudge" is a phenomenon that a fixed image is strongly scraped and thereby stained). This method proved effective to prevent smudging but still insufficient in improving scratch resistance when applied to an MICR system in which a fixed image is repeated scratched.

If a polyolefin is added in an amount higher than in a conventional toner, a further improvement of scratch resistance would be expected. However, substantially incompatible with a toner, a polyolefin added in an increased amount results in poor dispersibility, failing to obtain sufficient scratch resistance in an actual MICR system. Moreover, in printing, a toner having an increased polyolefin content contaminates a toner support, reduces the image density, causes background stains, and deteriorates maintenance.

JP-A-2-251968 teaches a technique for improving dispersibility of a substance incompatible with a toner, such as a polyolefin, and thereby improving fluidity and image forming performance of a toner, in which a polyolefin is dispersed to a maximum dispersed particle size of not greater than 5 μm. This technique improves image forming performance in the initial stage. However, considering that a toner usually has a particle size of about 10 μm, such a dispersed particle size of 5 μm as above noted which corresponds to a half of the toner particle size is insufficient for assuring satisfactory dispersibility. When applied to a one-component development process in particular, a reduction in image formation maintenance will occur due to contamination of a toner support in a long-term running test. Taking into consideration the latest tendency toward size reduction of toner particles to 7 μm and even to 5 μm aiming at high definition, such a maximum dispersed particle size as reaches 5 μm, which corresponds to almost the whole size of toner particles, must involve a reduction in image density, background staining, and deterioration of image formation maintenance. Additionally, the scratch resistance of this toner will be reduced due to the magnetic substance present therein to an impractical degree in the MICR system in which a fixed image repeatedly undergoes vigorous scratching.

Further, a toner containing finely dispersed polyolefin particles in a relatively large proportion as discussed above tends to have excessive chargeability (charging-up) particularly in a low temperature and low humidity environment (e.g., 10° C., 15% R.H.). Such being the case, so-called ghost development, a phenomenon in which a former image appears in a succeeding image to give a density more than necessary in a solid part, sometimes occurs. Should ghost development take place in an MICR system even to such a degree that gives rise to no practical problem in a conventional printer, cases are sometimes met with in which the magnetic characters have too high or too low magnetic intensity to be read.

Thus, a magnetic toner exhibiting excellent performance in an MICR system has not yet been developed.

SUMMARY OF THE INVENTION

An object of the present invention is to provide a magnetic toner having adequate magnetic force enabling correct magnetic character reading with an MICR.

Another object of the present invention is to provide a magnetic toner providing a toner image which hardly falls off from an image support even when repeatedly scratched with a magnetic head for magnetic reading and therefore causes no image quality reduction, no image stains or no magnetic head contamination.

A still another object of the present invention is to provide a magnetic toner which provides a toner image which can be read with an MICR at a practically acceptable level of reject rate (reading error rate).

A yet another object of the present invention is to provide a magnetic toner which is less causative of contamination of a toner support and excellent in maintenance.

A further object of the present invention is to provide a magnetic toner which provides a toner image of high density with reduced background stains or blurs.

A still further object of the present invention is to provide a magnetic toner exhibiting satisfactory fixing properties.

A yet further object of the present invention is to provide a magnetic toner capable of developing a highly fine digital latent image with high definition.

A furthermore object of the present invention is to provide a magnetic toner which has excellent environmental stability, causing no ghost development even in a low temperature and low humidity environment.

A furthermost object of the present invention is to provide a process for producing a magnetic toner having finely dispersed therein a polyolefin.

As a result of extensive investigations, the present inventors have found that the above objects are accomplished by specifying a residual magnetization of a magnetic toner ($\sigma_r$), contents of a magnetic substance and a polyolefin in the magnetic toner, and a mean dispersed particle size of the polyolefin. The present invention has been completed based on this findings.

The present invention relates to a magnetic toner comprising a binder resin, a magnetic substance, and polyolefin fine particles, wherein the content of the magnetic substance is from 20 to 80% by weight, the polyolefin fine particles have a mean dispersed particle diameter of from 0.01 to 0.5 μm, the content of the polyolefin fine particles is from 2 to 20% by weight, and the toner particles have a residual magnetization ($\sigma_r$) of from 4 to 7.0 emu/g.

It is preferable that the magnetic toner has adhered to the surface thereof inorganic oxide fine particles having a mean particle size of from 0.05 to 1.5 μm.

The present invention also relates to a process for producing the above-mentioned magnetic toner, which comprises blending a binder resin having finely dispersed therein a polyolefin with magnetic powder, melt-kneading the blend, and grinding the resulting mixture followed by classification.

DETAILED DESCRIPTION OF THE INVENTION

The polyolefin as polyolefin fine particles which can be used in the present invention can be selected from conventionally known ones. Polyethylene is especially effective to prevent smudging and to improve scratch resistance in an MICR system.

The polyolefin fine particles should have a mean dispersed particle diameter of from 0.01 to 0.5 μm, preferably from 0.01 to 0.3 μm, more preferably from 0.02 to 0.2 μm, and most preferably from 0.03 to 0.1 μm. If the mean dispersed particle diameter of the polyolefin is less than 0.01 μm, the toner has insufficient scratch resistance in an MICR system. Polyolefin particles greater than 0.5 μm contaminate a toner support in printing for a prolonged period of time to reduce the developing properties. The proportion of polyolefin dispersed particles or free polyolefin particles greater than 2 μm is preferably not more than 5%, more preferably not more than 3%, and most preferably not more than 1%, based on the total number of polyolefin particles.

The content of the polyolefin fine particles in the toner should fall within the range of from 2 to 20% by weight, preferably from 2 to 15% by weight, more preferably from 2 to 10% by weight, and more preferably from 2.5 to 7% by weight. If it is less than 2% by weight, the image wear is insufficient. If it exceeds 20% by weight, the developing properties are reduced.

The coefficient of variation of polyolefin dispersed particle size distribution is preferably from 20 to 40%, more preferably from 25 to 40%, and most preferably from 25 to 35%. If the coefficient of variation is smaller than 20%, smudges tend to become noticeable. If it is larger than 40%, development maintenance tends to be deteriorated. With the coefficient of variation falling within the above range, development maintenance is improved, and anti-fog latitude is broadened.

The coefficient of variation as above noted is obtained by slicing a toner particle with a cutter, such as a microtome, to a thickness of 0.3 μm, taking an electron micrograph at a magnification of 9,000 with a transmission electron microscope, and analyzing about 100 polyolefin particles randomly selected by means of an image analyzer. The coefficient of variation (%) is obtained from formula:

(standard deviation/mean dispersed particle diameter) × 100.

The particle size of a toner is measured with a Coulter counter "TA-II" manufactured by Coulter Counter Co. at an aperture of 100 μm.

The magnetic substance which can be used in the present invention is not limited, and any known magnetic substance can be employed. Suitable magnetic substances include needle-shaped magnetic substances, doped magnetic substances, and heat-treated magnetic substances. Heat-treated magnetic substances are particularly preferred because they have satisfactory dispersibility and provide a magnetic toner having excellent development stability, such as environmental stability. Included in heat-treated magnetic substances is a powder prepared by oxidizing a cubic magnetic substance by heating in an oxidizing atmosphere at 700° C. for 100 minutes, once cooling the substance, reducing the substance in a hydrogen atmosphere at 300° C. for 200 minutes, and cooling and pulverizing the substance.

The magnetic powder preferably has a residual magnetization ($\sigma_r m$) of from 7 to 24 emu/g, more preferably from 7 to 16 emu/g, and most preferably from 8 to 14 emu/g. If the residual magnetization of the magnetic powder is less than 7 emu/g or more than 24 emu/g, the magnetic force tends to be too weak or too strong, respectively, for correct reading.

The content of the magnetic powder in the toner should fall within a range of from 20 to 80% by weight, preferably from 30 to 70% by weight, and more preferably from 40 to 60% by weight. If the content is less than 20% by weight, charge control is difficult, and image density reduction and non-uniform development may occur particularly in a low temperature and low humidity environment, resulting in a failure of reading the image correctly with an MICR. If the magnetic powder content exceeds 80% by weight, the fixing properties are so deteriorated that the toner image is scraped off or the magnetic powder falls off on repeated friction with an MICR, leading to a failure of correct reading.

The binder resin which can be used in the present invention includes homopolymers of a vinyl monomer and copolymers of two or more vinyl monomers. Typical vinyl monomers include styrene, p-chlorostyrene, vinylnaphthalene, ethylenically unsaturated monoolefins (e.g., ethylene, propylene, butylene and isobutylene), vinyl halides (e.g., vinyl chloride, vinyl bromide, and vinyl fluoride), vinyl esters (e.g., vinyl acetate, vinyl propionate, vinyl benzoate, vinyl butyrate, vinyl formate, vinyl stearate, and vinyl caproate), ethylenically unsaturated monocarboxylic acids and esters thereof (e.g., methyl acrylate, ethyl acrylate, n-butyl acrylate, isobutyl acrylate, dodecyl acrylate, n-octyl acrylate, 2-chloroethyl acrylate, phenyl acrylate, methyl-α-chloroacrylate, methyl methacrylate, ethyl methacrylate, and butyl methacrylate), methylenically unsaturated monocarboxylic acid derivatives (e.g., acrylonitrile, methacrylonitrile, and acrylamide), ethylenically unsaturated dicarboxylic acids and esters thereof (e.g., dimethyl maleate, diethyl maleate, and dibutyl maleate), vinyl ketones (e.g., vinyl methyl ketone, vinyl hexyl ketone, and methyl isopropenyl ketone), vinyl ethers (e.g., vinyl methyl ether, vinyl isobutyl ether, and vinyl ethyl ether), vinylidene halides (e.g., vinylidene chloride and vinylidene chlorofluoride), and N-vinyl compounds (e.g., N-vinylpyrrole, N-vinylcarbazole, N-vinylindole, and N-vinylpyrrolidone). These vinyl polymers may be used in combination with polyester resins.

In a preferred embodiment of the present invention, a polyester resin is used as a binder resin for obtaining low-temperature fixing properties.

Suitable acid components for preparing polyester resins which can be used in the present invention include aromatic polycarboxylic acids, such as terephthalic acid, isophthalic acid, phthalic acid, naphthalenedicarboxylic acid, trimellitic acid, pyromellitic acid, and benzophenonetetracarboxylic acid; diphenylpolycarboxylic acids, such as diphenyl-p,p'-dicarboxylic acid and diphenylmethane-p,p'-dicarboxylic acid; aromatic hydroxycarboxylic acids, such as p-(2-hydroxyethoxy)-benzoic acid; aliphatic polycarboxylic acids, such as succinic acid, fumaric acid, adipic acid, azelaic acid, sebacic acid, decamethylenedicarboxylic acid, 1,2,4-butyltricarboxylic acid, 1,2,5-hexanetricarboxylic acid, and 1,3-dicarboxy-2-methylenecarboxypropane; alicyclic polycarboxylic acids, such as 1,4-cyclohexanedicarboxylic acid, 1,3-cyclohexanedicarboxylic acid, cyclohexanetricarboxylic acid, hexahydrophthalic acid, and tetrahydrophthalic acid; and anhydrides and reactive derivatives of these carboxylic acids.

Suitable alcohol components for preparing polyester resins which can be used in the present invention include aliphatic polyols, such as ethylene glycol, propylene glycol, 1,4-butanediol, 1,3-butanediol, 1,5-pentanediol, 1,6-hexanediol, neopentyl glycol, glycerin, trimethylolethane, trimethylolpropane, pentaerythritol, 1,2,3,6-hexanetetrol, dipentaerythritol, tripentaerythritol, 2-methylpropanetriol, and 2-methyl-l,2,4-butanetriol; alicyclic polyols, such as 1,4-cyclohexanediol and 1,4-cyclohexanedimethanol; aromatic polyols, such as 1,3,5-trihydroxymethylbenzene; an ethylene oxide or propylene oxide adduct of bisphenol A; and sorbitan derivatives, such as sorbitol and 1,4-sorbitan.

Use of the above-mentioned polyester binder resins lowers an optimum fixing temperature and, on account of the polar group thereof, enhances the fixing strength. These polyester resins are also effective to endow the magnetic powder with resistant against separation from a toner image support.

The binder resin which can be used in the present invention preferably has a number average molecular weight (Mw) of from 2,000 to 30,000 and a weight average molecular weight (Mw) of from 20,000 to 400,000 when measured by gel permeation chromatography (GPC) method, and a glass transition temperature (Tg) of from 55° to 75° C. (more preferably from 60° to 70° C.). The binder resin preferably comprises a high-molecular weight component and a low-molecular weight component. The high-molecular weight component has a weight average molecular weight of from 80,000 to 3,000,000, preferably 100,000 to 2,000,000 when measured by GPC method. The low-molecular weight component has a weight average molecular weight of less than 20,000, preferably 1,000 to 15,000, more preferably 3,000 to 10,000. The low-molecular weight component includes a graft or block copolymer, such as a graft or block copolymer comprising a polyolefin and a vinyl monomer. The polyolefin of the graft or block copolymer constituting the low-molecular weight component may be the same as or different from the polyolefin which is to be dispersed in the binder resin.

As a constituent of the high-molecular weight component and the low-molecular weight component, stylene type resins, alkyl methacrylate esters, alkyl acrylate esters and copolymers thereof are preferred. When a copolymer of stylene and (meth)acrylate is the constitute of the binder resin, the amount of the stylene type monomer is preferably not less than 50 wt. %, more preferably not less than 60 wt. %. The binder resin having plural peaks in molecular weight distribution may be prepared by multi-step polymerization reaction by using plural polymerization initiators having different reaction rates or by mixing a low-molecular weight component and a high-molecular weight component separately prepared in advance.

If desired, the magnetic toner of the present invention may contain various compounds for charge control or electric resistivity control, such as fluorine-containing surface active agents, azo dyes, salicylic acid-metal complex dyes, high-molecular weight acids, such as copolymers containing a maleic acid monomer unit, quaternary ammonium salts, azine dyes, such as nigrosine, and carbon black. The charge control agent may be used in an amount of 0.01 to 10 wt. % based on the toner. The other additives may be used in an amount of 0.01 to 30 wt. % based on the toner.

Where a polyester resin is used as a binder resin, while addition of a charge control agent is not essential because of the negative chargeability of the polyester resin per se, the above-mentioned charge control agents may be added if desired.

For the purpose of improving durability, fluidity or cleanability of the magnetic toner, the magnetic toner of the present invention may further contain inorganic fine powders, such as silica, organic fine powders, such as fatty acids and derivatives or metal salts thereof, and fine particles of resins, such as fluorine-containing resins, acrylic resins, and styrene-based resins. These additives other than silica may be used in an amount of 0.01 to 30 wt. % based on the toner.

The magnetic toner comprising the above-mentioned components preferably has an average particle diameter $D_{50}$ of from 4 to 9 μm.

The magnetic toner of the present invention should have a residual magnetization ($\sigma_r$) from 4 to 7 emu/g, preferably from 4.2 to 7 emu/g, and more preferably from 4.5 to 6.5 emu/g. If the residual magnetization of the toner is less than 4 emu/g or more than 7 emu/g, the magnetic force is too weak or too strong for correct reading.

In the present invention, the residual magnetization of toner particles or magnetic powder was measured with "VSM P-7" manufactured by Toei Kogyosha in a magnetic field of 5 kOe.

In a preferred embodiment of the present invention, fine particles of an inorganic oxide, such as titanium oxide or silica, are adhered to the surface of the toner particles. Titanium oxide fine particles to be used preferably have a volume resistivity of from $1\times10^7$ to $2\times10^8$ Ωcm, an $Al_2O_3$ content of from 1.0 to 2.0% by weight, and an $SiO_2$ content of from 0.05 to 0.4% by weight. Silica fine particles to be used are preferably spherical silica particles, particularly those prepared by deflagration, i.e., abrupt combustion of silicon and oxygen at a reaction rate of hundreds of meters per second. Silica particles obtained by deflagration generally have a true spherical shape having a smooth surface and a density of 1.8 mg/m$^3$ or more.

A preferred mean particle size of the inorganic oxide particles generally ranges from 0.05 to 1.5 μm. A preferred mean particle size of titanium oxide particles is from 0.1 to 1.0 μm, and more preferably from 0.2 to 0.5 μm. A preferred mean particle size of silica particles is from 0.1 to 1.0 μm, and more preferably from 0.3 to 1.0 μm. Addition of inorganic oxide particles smaller than 0.05 μm tends to cause insufficient image density or produces only small effects on prevention of comets and filming. Inorganic oxide particles greater than 1.5 μm produce only small effects on prevention of ghost development and tend to scratch a latent image carrier, causing image defects such as comets.

The amount of the inorganic oxide particles to be externally added is appropriately selected. For example, titanium oxide is preferably added in an amount of from 0.1 to 1.5% by weight, more preferably from 0.3 to 1.2% by weight, and most preferably from 0.5 to 1.0% by weight, based on the toner. Spherical silica is preferably added in an amount of from 0.05 to 1.0% by weight, more preferably from 0.1 to 1.0% by weight, and most preferably from 0.1 to 0.5% by weight, based on the toner. Addition of inorganic oxide particles in smaller amounts produces insubstantial effects in prevention of comets, ghosts and filming. Addition in larger amounts tends to deteriorate powder fluidity, resulting in non-uniform development.

The mechanism of action of the inorganic oxide fine particles externally added to toner particles is explained below. A toner containing finely dispersed polyolefin particles in a somewhat large proportion is liable to be excessively charged (charging-up) particularly in a low temperature and low humidity environment for some unknown reasons. It seems that a highly crystalline polyolefin, finely and uniformly dispersed in toner particles, is fused during grinding or classification to form a film on the surface of the toner particles. Such a polyolefin film will prevent a charge control agent or magnetic powder present on the toner surface from making sufficient contact with a toner support and cause excessive accumulation of charges (charging-up phenomena) in the toner. As a result, ghost development occurs, and the ghosts cause an increase of a reject rate in reading with an MICR.

In addition, since the toner of the present invention contains finely dispersed polyolefin particles in a relatively large amount, cases sometimes occur where part of the toner or part of a toner component gradually cakes or fuses on a latent image carrier during long-term use particularly under a low temperature and low humidity condition to cause comets or filming. The comets and filming appear on a solid image area as white spots, which leads to an increase of reject rate in reading with an MICR even if the image defect is not much to give rise to problem in printing.

The magnetic toner of the present invention is preferably negatively chargeable. The magnetic toner may be charged in an amount of −5 to −60 μc/g, preferably −10 to −40 μc/g.

Inorganic oxide fine particles adhered to the surface of toner particles appear to moderately scrape the cake of the toner on a latent image carrier thereby reducing ghosts, comets and filming.

The magnetic toner of the present invention can be prepared by any process in which a polyolefin can be incorporated into toner particles in a finely dispersed state. For example, a polyolefin may previously be ground to powder having a particle size of not greater than 10 μm before it is melt kneaded with a binder resin and other toner components in a known kneading machine, such as an extruder. All the components including a polyolefin may be kneaded in the presence of water while suppressing a temperature rise so as to apply sufficient shearing force to the mixture. A dispersant, such as an oxidized wax, may be used in combination.

In the present invention, the magnetic toner is preferably produced by a process comprising previously preparing a binder resin having finely dispersed therein a polyolefin and mixing the resin with magnetic powder. According to this process, a polyolefin can be finely dispersed efficiently. The efficiency is further increased by using a graft or block copolymer containing a polyolefin as a constituent component (hereinafter simply referred to as a polyolefin graft or block copolymer) as a dispersant. It is preferable that the polyolefin graft or block copolymer as a dispersant should comprise at least one of the monomer units constituting the binder resin. In this case, the size distribution of the polyolefin fine particles is further narrowed.

In carrying out the above-mentioned process in which a binder resin having finely dispersed therein a polyolefin is previously prepared, a polyolefin may be added to a system for preparation of a binder resin, for example, during polymerization of monomers or may be added to a binder resin in a molten state and dispersed therein in the presence of the above-mentioned polyolefin graft or block copolymer as a dispersant to a dispersed particle size of not greater than 3 μm. Part of the polyolefin may be added to the polymerization system to form a polyolefin graft or block copolymer, which serves as a dispersant. In this case, there is obtained a binder resin containing polyolefin fine particles with a narrow particle size distribution.

Dispersion of a polyolefin to a desired particle size is preferably effected in two steps as follows. In a first step, a polyolefin is previously dispersed in a binder resin to a particle size of not more than about 3 μm. The polyolefin may be dispersed in a system for producing a binder resin, for example, at the time of polymerization or in a molten binder resin by using a block or grafted polymer as a dispersing agent. More specifically, a polyolefin powder is dissolved in a solution containing a monomer for the binder resin in a solvent and graft polymerization is carried out using a polymerization initiator. Alternatively, a polyolefin powder is dissolved in a solution containing a binder resin, together with a graft polymer of the monomer of the binder resin and a vinyl monomer as a dispersing agent. While the binder resin may be a resin having two molecular weight distribution peaks corresponding to a low molecular weight polymer component and a high molecular weight component for the sake of control of its fixing temperature, the polyolefin is preferably incorporated in a system for producing the low molecular weight component of the binder resin in the same manner as described above. In a second step, a commonly employed procedure for producing a toner is adopted. Prior to the second step, a solvent used in the first step is removed from the resin solution obtained in the first step. Dispersion of the polyolefin in the second step is effected simultaneously with blending and dispersion of a magnetic substance, etc. by means of a roll mill, an extruder, and so on. In the second step, the polyolefin is finely dispersed to a final particle size of not more than 0.5 μm. An additional amount of a polyolefin, either the same as or different from that added in the first step, may be added in the second step. When the above-mentioned two-molecular weight peak binder resin is used, the polyolefin to be added in the second step is preferably added to the resin solution of the first step together with a high molecular weight component of the binder resin that is separately prepared by bulk polymerization, solution polymerization and the like, and then the solvent of the resin solution is removed, followed by dispersion of the polyolefin. In this case, the weight ratio of the polyolefin added in the first step to that added in the second step preferably ranges from 10:1 to 1:10 and more preferably from 1:10 to 5:10.

The coefficient of variation as defined in the present invention can be attained when the polyolefin is dispersed in a binder resin in the above-mentioned two-step process. The coefficient of variation can be reduced by adding the polyolefin(s) in the first and second steps in the preferred weight ratio of 1:10 to 5:10.

The thus prepared binder resin having finely dispersed therein a polyolefin is then blended with magnetic powder and melt-kneaded by means of a roll mill, an extruder or any other generally employed kneading machine. The polyolefin particles are further reduced to 0.5 μm or less through this kneading step. The resulting mixture is ground and classified to obtain a magnetic toner having a desired particle size. The grinding is preferably performed by a mechanical means. The classification is preferably effected by utilizing a co-under effect.

The present invention will now be illustrated in greater detail with reference to Preparation Examples and Examples, but it should be understood that the present invention is not construed as being limited thereto. All the parts, percents and ratios are given by weight unless otherwise indicated.

PREPARATION EXAMPLE 1

| | |
|---|---|
| Xylene | 1000 g |
| Styrene monomer | 617.5 g |
| n-Butyl acrylate monomer | 32.5 g |
| Di-t-butyl peroxide | 45.5 g |
| Polyethylene (Mn: 3,000) | 10 g |

The above components were put in a 3 l reaction vessel and heated to 155° C. to conduct solution polymerization to obtain a xylene solution of a low-molecular weight styrene-acrylate copolymer containing a minor proportion of a polyethylene-grafted styrene-acrylate copolymer. The copolymer had a weight average molecular weight (Mw) of 5,700.

In the xylene solution were dissolved 350 g of a separately prepared styrene-n-butyl acrylate (75/25) copolymer having an Mw of 820,000 and 60 g of the same polyethylene as used above. Xylene was removed from the resulting solution at about 210° C. to obtain a resin composition containing about 7% of polyethylene particles having a mean dispersed particle diameter of from 0.1 to 2 μm.

PREPARATION EXAMPLE 2

A xylene solution of a low-molecular weight styrene-acrylate copolymer was synthesized in the same manner as in Preparation Example 1, except that polyethylene was not added. The resulting copolymer had an Mw of 5,900.

In the resulting xylene solution were dissolved the following components.

| | |
|---|---|
| High-molecular weight styrene-acrylate (75/25) copolymer (Mw: 820,000) | 350 g |
| Polyethylene (Mn: 3,000) | 70 g |
| Styrene-ethylene graft copolymer ("G1701X" produced by Shell Chemical Co.) | 23 g |

Xylene was removed from the resulting mixture at about 210° C. to obtain a resin composition containing about 7% of polyethylene particles having a mean dispersed particle diameter of from 0.1 to 3 μm.

PREPARATION EXAMPLE 3

A resin composition was prepared in the same manner as in Preparation Example 1, except that polyethylene was not used.

PREPARATION EXAMPLE 4

| | |
|---|---|
| Xylene | 1000 g |
| Styrene monomer | 680.5 g |
| 2-Ethylhexyl acrylate monomer | 19.5 g |
| Di-t-butyl peroxybenzoate | 58.5 g |
| Polyethylene (Mn: 3,000) | 10 g |

The above components were put in a 3 l reaction vessel and heated to 155° C. to conduct solution polymerization to obtain a xylene solution of a low-molecular weight styrene-acrylate copolymer containing a minor proportion of a polyethylene-grafted styrene-acrylate copolymer. The copolymer had an Mw of 5,500.

To the xylene solution were added 350 g of a styrene-2-ethylhexyl acrylate (82/18) copolymer having an Mw of 850,000 separately prepared by suspension polymerization and 60 g of the same polyethylene as used above, and xylene was removed from the resulting solution at about 210° C. to obtain a resin composition containing about 7% of polyethylene particles having a mean dispersed particle diameter of from 0.1 to 2 μm.

PREPARATION EXAMPLE 5

A xylene solution of a low-molecular weight styrene-acrylate copolymer was synthesized in the same manner as in Preparation Example 4, except that polyethylene was not added. The resulting copolymer had an Mw of 5,400.

In the resulting xylene solution were dissolved the following components.

| | |
|---|---|
| High-molecular weight styrene-2-ethyl acrylate (82/18) copolymer (Mw: 850,000) | 350 g |
| Polyethylene (Mn: 3,000) | 70 g |
| Styrene-ethylene graft copolymer (G1701X) | 20 g |

Xylene was removed from the resulting mixture at about 210° C. to obtain a resin composition containing about 7% of polyethylene particles having a mean dispersed particle diameter of from 0.1 to 3 μm.

PREPARATION EXAMPLE 6

A resin composition was prepared in the same manner as in Preparation Example 4, except for using no polyethylene.

PREPARATION EXAMPLE 7

| | |
|---|---|
| Xylene | 1000 g |
| Styrene monomer | 585 g |
| Maleic ester monomer | 32.5 g |
| n-Butyl acrylate monomer | 32.5 g |
| Di-t-butyl peroxide | 65 g |
| Polyethylene (Mn: 3,000) | 10 g |

The above components were put in a 3 l reaction vessel and heated to 152° C. to conduct solution polymerization to obtain a xylene solution of a low-molecular weight styrene-acrylate-maleate copolymer containing a minor proportion of a polyethylene-grafted styrene-acrylate-maleate copolymer. The copolymer had an Mw of 5,900.

To the xylene solution were added 350 g of a styrene-n-butyl acrylate (75/25) copolymer having an Mw of 820,000 separately prepared by suspension polymerization and 60 g of the same polyethylene as used above, and xylene was removed from the resulting solution at about 215° C. to obtain a resin composition containing about 7% of polyethylene particles having a mean dispersed particle diameter of from 0.1 to 2 μm.

PREPARATION EXAMPLE 8

A xylene solution of a low-molecular weight styrene-acrylate-maleate copolymer was synthesized in the same manner as in Preparation Example 7, except that polyethylene was not added. The resulting copolymer had an Mw of 6,000.

In the resulting xylene solution were dissolved the following components.

| | |
|---|---|
| High-molecular weight styrene-acrylate (75/25) copolymer (Mw: 820,000) | 350 g |
| Polyethylene (Mn: 3,000) | 70 g |
| Styrene-ethylene graft copolymer (G1701X) | 25 g |

Xylene was removed from the resulting mixture at about 215° C. to obtain a resin composition containing about 7% of polyethylene particles having a mean dispersed particle diameter of from 0.1 to 3 μm.

PREPARATION EXAMPLE 9

A resin composition was prepared in the same manner as in Preparation Example 7, except for using no polyethylene.

Magnetic substances used in Examples hereinafter given are shown in Table 1 below.

TABLE 1

| Magnetic Substance | Composition | $\sigma/\tau$ (emu/g) | Shape | BET Specific Surface Area ($cm^2/mg$) |
|---|---|---|---|---|
| A | heat-treated magnetite | 12.0 | amorphous | 6.3 |
| B | Co-doped magnetite | 14.6 | hexagonal | 7.2 |
| C | needle magnetite | 30.1 | needle-like | 20.6 |
| D | magnetite | 9.1 | octagonal | 6.6 |

EXAMPLE 1

| | |
|---|---|
| Resin composition of Preparation Example 1 | 48.2% |
| Magnetic substance A | 50% |
| Negative charge control agent ("Bontron E-84" produced by Orient Kagaku K.K.) | 1.8% |

The above components were dry blended in a Henschel mixer and melt-kneaded in an extruder at 140° C. After cooling, the mixture was crushed and then ground to obtain grinds having a 50 percent volumetric mean particle diameter ($D_{50}$) of 8.1 μm. The grinds were classified to obtain powder having a $D_{50}$ of 8.4 μm with the proportion of particles of not greater than 5.0 μm being 15% based on the number of particles and the proportion of particles not smaller than m being 0% based on the volume of particles. The powder was mixed with 0.6% of hydrophobic colloidal silica fine powder in a Henschel mixer to prepare a magnetic toner having a residual magnetization ($\sigma_r$) of 5.2 emu/g, in which the polyolefin particles had a mean dispersed particle diameter of 0.30 μm at a coefficient of size variation of 30% with the proportion of coarse particles of 2 μm or greater being 0% based on the number of particles.

A printing test of the resulting magnetic toner was carried out using a printer "4197" manufactured by Fuji Xerox Co., Ltd. modified so as to have a definition of 600 dpi under a high temperature and high humidity condition (30° C., 85% RH) or a low temperature and low humidity condition (10° C., 15% RH). The image density and fog density were measured in the initial stage of printing and after obtaining 5,000 prints. The results obtained are shown in Table 2 below.

Further, suitability of the magnetic toner to an MICR system was evaluated according to the following test methods.

1) Signal Intensity

A check paper was printed with the magnetic toner, and the magnetism of the printed toner image was measured with Sigma Measure IV manufactured by XYTEC Corp. Measurements of 10,000 checks was averaged. It has been confirmed that no error occurs in actual reading with a reader sorter of an MICR system as long as the signal intensity as measured as described above is between 100% and 200%.

2) Scratch Resistance

About 500 checks printed with the magnetic toner were each read 30 times with a reader sorter "IBM-3890 MICR Reader Sorter" manufactured by IBM Corp., and the following items were examined.

2-1) Smears

A phenomenon that surroundings of printed characters and the background are stained with the toner which has fallen off or has been scraped off the image area. Ratings were given based on standard samples separately prepared.

2-2) Foil Contamination

A phenomenon that the toner which has fallen off or has been scraped off the image area adheres to the protective tape of a magnetic head. Ratings were given based on separately prepared standard samples.

2-3) Reject Rate

Checks which cannot be read with a reader sorter are automatically rejected as errors. The reject rate (%) is represented by formula: (the number of rejected checks/total number of tested checks)×100.

Smears and foil contamination are considered as causes of reading errors in an MICR system. The reject rate is a rate of errors which occur in actual reading due to not only smears and foil contamination but other causes, such as improper signal intensity.

The results obtained are shown in Table 2.

COMPARATIVE EXAMPLE 1

A magnetic toner was obtained in the same manner as in Example 1, except for replacing the resin composition used in Example 1 with 44.83% of the resin composition of Preparation Example 3 and adding 3.37% of polyethylene. The resulting magnetic toner had a residual magnetization ($\sigma_r$) of 5.1 emu/g and a $D_{50}$ of 8.4 μm with the proportion of those particles not greater than 5.0 μm being 17% based on the number of particles and the proportion of those particles not smaller than 20 μm being 0% based on the volume of particles, in which the polyolefin particles had a mean dispersed particle diameter of 1.5 μm at a coefficient of size variation of 55% with the proportion of coarse particles of 2 μm or greater being 12% based on the number of particles.

The resulting toner was evaluated in the same manner as in Example 1. The results obtained are shown in Table 2.

EXAMPLE 2

A magnetic toner was prepared from the following components in the same manner as in Example 1, except for changing the amount of hydrophobic colloidal silica to 0.5%.

| | |
|---|---|
| Resin composition of Preparation Example 1 | 49.5% |
| Magnetic substance A | 25% |
| Magnetic substance D | 25% |
| Negative charge control agent ("Spiron Black TRH" produced by Hodogaya Chemical Co., Ltd.) | 0.5% |

The resulting magnetic toner had a residual magnetization ($\sigma_r$) of 4.8 emu/g and a $D_{50}$ of 11.5 μm with the proportion of those particles not greater than 5.0 μm being 10% based on the number of particles and the proportion of those particles not smaller than 20 μm being 0.5% based on the volume of particles, in which the polyolefin particles had a mean dispersed particle size of 0.25 μm at a coefficient of size variation of 27% with the proportion of coarse particles of 2 μm or greater based on the number of particles being 0%.

The resulting toner was evaluated in the same manner as in Example 1. The results obtained are shown in Table 2.

EXAMPLE 3

A magnetic toner was prepared from the following components in the same manner as in Example 1, except for changing the amount of hydrophobic colloidal silica to 0.4%.

| | |
|---|---|
| Resin composition of Preparation Example 2 | 49.8% |
| Magnetic substance C | 10% |
| Magnetic substance D | 40% |
| Negative charge control agent ("Bontron S-34" produced by Orient Kagaku K.K.) | 0.2% |

The resulting magnetic toner had a residual magnetization ($\sigma_r$) of 6.4 emu/g and a $D_{50}$ of 8.8 μm with the proportion of those particles not greater than 5.0 μm being 22% based on the number of particles and the proportion of those particles not smaller than 20 μm being 0% based on the volume of particles, in which the polyolefin particles had a mean dispersed particle size of 0.28 μm at a coefficient of size variation of 31% with the proportion of coarse particles of 2 μm or greater based on the number of particles being 1%.

The resulting toner was evaluated in the same manner as in Example 1. The results obtained are shown in Table 2.

COMPARATIVE EXAMPLE 2

A magnetic toner was obtained in the same manner as in Example 3, except for replacing the resin composition used in Example 3 with 46.31% of the resin composition of Preparation Example 3 and adding 3.49% of polyethylene. The resulting magnetic toner had a residual magnetization ($\sigma_r$) of 6.5 emu/g and a $D_{50}$ of 9.2 μm with the proportion of those particles of not greater than 5.0 μm being 19% based on the number of particles and the proportion of those particles not smaller than 20 μm being 0% based on the volume of particles, in which the polyolefin particles had a mean dispersed particle size of 1.1 μm at a coefficient of size variation of 41% with the proportion of coarse particles of 2 μm or greater being 4% based on the number of particles.

The resulting toner was evaluated in the same manner as in Example 1. The results obtained are shown in Table 2.

COMPARATIVE EXAMPLE 3

A magnetic toner was obtained in the same manner as in Example 1, except for replacing magnetic substance A with magnetic substance D. The resulting magnetic toner had a residual magnetization ($\sigma_r$) of 3.8 emu/g and a $D_{50}$ of 8.7 μm with the proportion of those particles not greater than 5.0 μm being 14% based on the number of particles and the proportion of those particles not smaller than 20 μm being 0% based on the volume of particles, in which the polyolefin particles had a mean dispersed particle size of 0.23 μm at a coefficient of size variation of 35% with the proportion of coarse particles of 2 μm or greater being 0% based on the number of particles.

The resulting toner was evaluated in the same manner as in Example 1. The results obtained are shown in Table 2.

EXAMPLE 4

A magnetic toner was prepared from the following components in the same manner as in Example 1, except for using 0.4% of positively chargeable hydrophobic colloidal silica as an external additive.

| | |
|---|---|
| Resin composition of Preparation Example 1 | 47.9% |
| Magnetic substance C | 10% |
| Magnetic substance D | 40% |
| Positive charge control agent ("Bontron P-51" produced by Orient Kagaku K.K.) | 2.1% |

The resulting magnetic toner had a residual magnetization ($\sigma_r$) of 6.4 emu/g and a $D_{50}$ of 11.0 μm with the proportion of those particles not greater than 5.0 μm being 7% based on the number of particles and the proportion of those particles not smaller than 20 μm being 0.2% based on the volume of particles, in which the polyolefin particles had a mean dispersed particle size of 0.28 μm at a coefficient of size variation of 35% with the proportion of coarse particles of 2 μm or greater being 0% based on the number of particles.

The resulting toner was evaluated in the same manner as in Example 1, except that the photoreceptor of the printer "4197" was replaced with an amorphous silicon photoreceptor and that conditions of charging, transfer and development were altered to those for a positively chargeable toner. The results obtained are shown in Table 2.

In Table 2 and other tables hereinafter given, the results of evaluation of smears, blurs, fixing properties, ghosts, image quality, and comets were rated A to E according to the following standard.

| | |
|---|---|
| A | Excellent |
| B | Good |
| C | Satisfactory for practical use |
| D | Limit for practical use |
| E | Impractical |
| F | Poor |

In Table 2 and other tables, the reject rates obtained were rated A to D according to the following standard.

| | |
|---|---|
| A | 0 to 0.5%, excellent |
| B | 0.5 to 1.5%, good |
| C | 1.5 to 5%, limit for practical use |
| D | 5% or more, no use |

TABLE 2

| Example No. | Image Quality in Initial Stage: 30° C., 85% RH Image Density | 30° C., 85% RH Fog Density | 10° C., 15% RH Image Density | 10° C., 15% RH Fog Density | Image Density After Obtaining 5000 Prints: 30° C., 85% RH | 10° C., 15% RH | Signal Intensity (%) | Smears | Reject Rate (%) | Blurs | Fixing Properties |
|---|---|---|---|---|---|---|---|---|---|---|---|
| Example 1 | 1.41 | 0 | 1.45 | 0 | 1.37 | 1.43 | 148 | B | 0.07 A | B | B |
| Example 2 | 1.39 | 0 | 1.47 | 0.4 | 1.35 | 1.44 | 155 | B | 0 A | C | B |
| Example 3 | 1.42 | 0 | 1.44 | 0 | 1.40 | 1.41 | 157 | B | 0.14 | C | B |

TABLE 2-continued

| Example No. | Image Quality in Initial Stage: 30° C., 85% RH: Image Density | Image Quality in Initial Stage: 30° C., 85% RH: Fog Density | Image Quality in Initial Stage: 10° C., 15% RH: Image Density | Image Quality in Initial Stage: 10° C., 15% RH: Fog Density | Image Density After Obtaining 5000 Prints: 30° C., 85% RH | Image Density After Obtaining 5000 Prints: 10° C., 15% RH | Signal Intensity (%) | Smears | Reject Rate (%) | Blurs | Fixing Properties |
|---|---|---|---|---|---|---|---|---|---|---|---|
| Example 4 | 1.40 | 0 | 1.43 | 0 | 1.38 | 1.40 | 155 | B | A 0 | C | A |
| Compar. Example 1 | 1.35 | 1.2 | 1.37 | 2.6 | 1.02 | 1.10 | 135 | C | A 1.9 | B | C |
| Compar. Example 2 | 1.42 | 0 | 1.43 | 1.2 | 1.12 | 1.20 | 152 | D | D 15.0 | D | C |
| Compar. Example 3 | 1.40 | 0 | 1.48 | 0 | 1.36 | 1.42 | 85 | B | F 4.5 | B | B |

EXAMPLE 5

| | |
|---|---|
| Polyester resin* | 45% |
| Heat-treated magnetite ($\sigma_r$): 12.1 emu/g) | 50% |
| Polyethylene wax | 4% |
| Dispersant (polyethylene-ethylene oxide block copolymer) | 1% |

*Prepared from fumaric acid and a bisphenol A propylene oxide adduct; Mw: 15,000; Mn: 4,000; Tg: 60° C.

The above components were dry blended and melt-kneaded in an extruder at 160° C. After cooling, the mixture was ground and classified to obtain grinds having a residual magnetization ($\sigma_r$) of 5.3 emu/g and a $D_{50}$ of 9.5 μm.

The resulting powder was mixed with 0.5% of hydrophobic colloidal silica in a Henschel mixer to obtain a magnetic toner.

EXAMPLE 6

A magnetic toner was prepared in the same manner as in Example 5, except that no dispersant was used, and the grinds were again kneaded, ground and classified.

Each of the magnetic toners obtained in Examples 5 and 6 was evaluated in the same manner as in Example 1. Additionally, the optimum fixing temperature was obtained. The results obtained are shown in Table 3 below.

Each of the magnetic toners obtained in Examples 5 and 6 was evaluated in the same manner as in Example 1, except for using a printer "4197" modified so that the fixing temperature might be varied. As for image density (SAD), the reflection density of the solid part was measured with "X-rite". Additionally, the temperature of the fixing roll at which the degree of fixing reached a practically acceptable level was measured as an indication of fixing properties. The results obtained are shown in Table 3 below. In Table 3, "scratch resistance" means the results of evaluation of smears and foil contamination. Smears and foil contamination were rated "A (good)", "B (limit for practical use)" or "C (impractical)", and the reject rates obtained were rated "A (not more than 0.5%)", "B (more than 0.5% and less than 1%)" or "C (not less than 1%)".

TABLE 3

| Example No. | $\sigma_r$ (emu/g) | Polyethylene Dispersed Particle Diameter (μm) | Signal Intensity | Scratch Resistance | Solid Image Density (SAD): Initial Stage | Solid Image Density (SAD): After Obtaining 10000 Prints | Reject Rate (%) | Minimum Fixing Temperature (°C.) |
|---|---|---|---|---|---|---|---|---|
| Example 5 | 5.3 | 0.2 | A | A | 1.46 | 1.42 | A | 153 |
| Example 6 | 5.5 | 0.4 | A | A | 1.45 | 1.40 | A | 145 |

EXAMPLE 7

| | |
|---|---|
| Resin composition of Preparation Example 4 | 49.4% |
| Magnetic substance A | 50% |
| Negative charge control agent (Bontron S-34) | 0.6% |

The above components were dry blended in a Henschel mixer and melt-kneaded in an extruder at 140° C. After cooling, the mixture was crushed and then ground to obtain grinds having a $D_{50}$ of 10.5 μm. The grinds were classified to obtain powder having a $D_{50}$ of 11.8 μm with the proportion of particles not greater than 5.0 μm being 9% based on the number of particles and the proportion of particles not smaller than 20 μm being 0% based on the volume of particles, in which the polyolefin particles had a mean dispersed particle size of 0.25 μm at a coefficient of size variation of 30% with the proportion of coarse particles of 2 μm or greater being 0% based on the number of particles. The powder had a residual magnetization ($\sigma_r$) of 5.0 emu/g.

The resulting powder was mixed with 0.6% of hydrophobic colloidal silica and 0.7% of titanium oxide having a particle size of 0.35 μm in a Henschel mixer to prepare a magnetic toner.

A printing test of the resulting magnetic toner was carried out using a printer "4197" modified so as to have an printing speed of 15 sheets/min. Suitability of the magnetic toner to an MICR system was evaluated in terms of smears, reject ratio, ghosts, and image quality in the same manner as in Example 1. The results obtained are shown in Table 4 below.

COMPARATIVE EXAMPLE 4

A magnetic toner was obtained in the same manner as in Example 7, except for replacing the resin composition used in Example 7 with 45.85% of the resin composition of Preparation Example 6 and adding 3.45% of polyethylene. The resulting magnetic toner had a residual magnetization ($\sigma_r$) of 5.1 emu/g and a $D_{50}$ of 11.6 μm with the proportion of those particles not greater than 5.0 μm being 8% based on the number of particles and the proportion of those particles not smaller than 20 μm being 0% based on the volume of particles, in which the polyolefin particles had a mean dispersed particle size of 1.5 μm at a coefficient of size variation of 47% with the proportion of coarse particles of 2 μm or greater being 8% based on the number of particles.

The resulting toner was evaluated in the same manner as in Example 7. The results obtained are shown in Table 4.

EXAMPLE 8

A magnetic toner was prepared from the following components in the same manner as in Example 7, except that 0.75% of hydrophobic colloidal silica and 0.9% of titanium oxide having a particle size of 0.3 μm were externally added.

| | |
|---|---|
| Resin composition of Preparation Example 5 | 49.5% |
| Magnetic substance C | 10% |
| Magnetic substance D | 40% |
| Negative charge control agent (Spiron Black TRH) | 0.5% |

The resulting magnetic toner had a residual magnetization ($\sigma_r$) of 6.5 emu/g and a $D_{50}$ of 8.1 μm with the proportion of those particles not greater than 5.0 μm being 23% based on the number of particles and the proportion of those particles not smaller than 20 μm being 0% based on the volume of particles, in which the polyolefin particles had a mean dispersed particle size of 0.33 μm at a coefficient of size variation of 29% with the proportion of coarse particles of 2 μm or greater being 0% based on the number of particles.

The resulting toner was evaluated in the same manner as in Example 7, except for using a printer "4197" modified to a definition of 600 dpi. The results obtained are shown in Table 4.

EXAMPLE 9

A magnetic toner was prepared in the same manner as in Example 8, except that titanium oxide was not added. The resulting magnetic toner has a residual magnetization ($\sigma_r$) of 6.5 emu/g and a $D_{50}$ of 8.0 μm with the proportion of those particles not greater than 5.0 μm being 24% based on the number of particles and the proportion of those particles not smaller than 20 μm being 0% based on the volume of particles. The magnetic toner was evaluated in the same manner as in Example 8. The results obtained are shown in Table 4.

EXAMPLE 10

A magnetic toner was prepared from the following components in the same manner as in Example 7, except that 0.5% of hydrophobic colloidal silica and 0.6% of titanium oxide having a particle size of 0.42 μm were externally added.

| | |
|---|---|
| Resin composition of Preparation Example 4 | 47.5% |
| Magnetic substance A | 25% |
| Magnetic substance D | 25% |
| Negative charge control agent (Bontron E-84) | 2.5% |

The resulting magnetic toner had a residual magnetization ($\sigma_r$) of 4.9 emu/g and a $D_{50}$ of 10.8 μm with the proportion of those particles not greater than 5.0 μm being 15% based on the number of particles and the proportion of those particles not smaller than 20 μm being 0% based on the volume of particles, in which the polyolefin particles had a mean dispersed particle size of 0.2 μm at a coefficient of size variation of 28% with the proportion of coarse particles of 2 μm or greater being 0% based on the number of particles.

The resulting toner was evaluated in the same manner as in Example 7. The results obtained are shown in Table 4.

EXAMPLE 11

A magnetic toner was prepared from the following components in the same manner as in Example 7, except that 0.4% of hydrophobic colloidal silica and 0.5% of titanium oxide having a particle size of 0.28 μm were externally added.

| | |
|---|---|
| Resin composition of Preparation Example 4 | 48.5% |
| Magnetic substance B | 50% |
| Positive charge control agent (Bontron P-51) | 2.0% |

The resulting magnetic toner had a residual magnetization ($\sigma_r$) of 6.0 emu/g and a $D_{50}$ of 11.2 μm with the proportion of those particles not greater than 5.0 μm being 13% based on the number of particles and the proportion of those particles not smaller than 20 μm being 0.2% based on the volume of particles, in which the polyolefin particles had a mean dispersed particle size of 0.23 μm at a coefficient of size variation of 34% with the proportion of coarse particles of 2 μm or greater based on the number of particles being 0%.

The resulting toner was evaluated in the same manner as in Example 7, except that the photoreceptor of the printer was replaced with an amorphous silicon photoreceptor and that conditions of charging, transfer and development were altered to those for a positively chargeable toner. The results obtained are shown in Table 4.

TABLE 4

| Example No. | Smears | Reject Rate | Ghosts | Image Quality |
|---|---|---|---|---|
| Example 7 | B | 0.0 (A) | A | B |
| Example 8 | B | 0.0 (A) | A | B |
| Example 9 | B | 0.2 (A) | C | C |
| Example 10 | B | 0.1 (A) | A | B |
| Example 11 | B | 0.0 (A) | A | B |
| Compar. Example 4 | C | 2.0 (D) | E | C |

EXAMPLE 12

| | |
|---|---|
| Resin composition of Preparation Example 7 | 49.3% |
| Magnetic substance A | 50% |
| Negative charge control agent (Spiron Black TRH) | 0.7% |

The above components were dry blended in a Henschel mixer and heat-kneaded in an extruder at 140° C. After cooling, the mixture was crushed and then ground to obtain grinds having a $D_{50}$ of 10.1 μm. The grinds were classified to obtain powder having a $D_{50}$ of 11.5 μm with the proportion of particles not greater than 5.0 μm being 10% based on the number of particles and the proportion of particles not smaller than 20 μm being 0% based on the volume of particles, in which the polyolefin particles had a mean dispersed particle size of 0.28 μm at a coefficient of size variation of 31% with the proportion of coarse particles of 2 μm or greater being 0% based on the number of particles. The powder had a residual magnetization ($\sigma_r$) of 5.1 emu/g.

The resulting powder was mixed with 0.5% of hydrophobic colloidal silica fine powder and 0.3% of silica powder prepared by deflagration having a particle size of 0.8 μm in a Henschel mixer to prepare a magnetic toner.

A printing test of the resulting magnetic toner was carried out using a printer "4197" modified so as to have a definition of 600 dpi and an printing speed of 15 sheets/min. Suitability of the magnetic toner to an MICR system was evaluated in the same manner as in Example 1 in terms of signal intensity, smears, reject rate, blurs, fixing properties, and comets. The results obtained are shown in Table 5 below.

COMPARATIVE EXAMPLE 5

A magnetic toner was obtained in the same manner as in Example 7, except for replacing the resin composition used in Example 12 with 45.85% of the resin composition of Preparation Example 9 and adding 3.45% of polyethylene. The resulting magnetic toner had a residual magnetization ($\sigma_r$) of 5.0 emu/g and a $D_{50}$ of 11.4 μm with the proportion of those particles not greater than 5.0 μm being 11% based on the number of particles and the proportion of those particles not smaller than 20 μm being 0% based on the volume of particles, in which the polyolefin particles had a mean dispersed particle size of 1.7 μm at a coefficient of size variation of 50% with the proportion of coarse particles of 2 μm or greater being 11% based on the number of particles.

The resulting toner was evaluated in the same manner as in Example 12. The results obtained are shown in Table 5.

EXAMPLE 13

A magnetic toner was prepared from the following components in the same manner as in Example 12, except that 0.8% of hydrophobic colloidal silica and 0.5% of silica powder prepared by deflagration having a particle size of 0.6 μm were externally added.

| | |
|---|---|
| Resin composition of Preparation Example 8 | 48.0% |
| Magnetic substance C | 10% |
| Magnetic substance D | 40% |
| Negative charge control agent (Bontron E-84) | 2.0% |

The resulting magnetic toner had a residual magnetization ($\sigma_r$) of 6.5 emu/g and a $D_{50}$ of 7.5 μm with the proportion of those particles not greater than 5.0 μm being based on the number of particles and the proportion of those particles not smaller than 20 μm being 0% based on the volume of particles, in which the polyolefin particles had a mean dispersed particle size of 0.3 μm at a coefficient of size variation of 33% with the proportion of coarse particles of 2 μm or greater being 0% based on the number of particles.

The resulting toner was evaluated in the same manner as in Example 12, except for modifying the printer to have a definition of 800 dip and a printing speed of 15 sheets/min. The results obtained are shown in Table 5.

EXAMPLE 14

A magnetic toner was obtained in the same manner as in Example 13, except for adding no titanium oxide. The resulting magnetic toner had a residual magnetization ($\sigma_r$) of 6.5 emu/g and a $D_{50}$ of 7.4 μm with the proportion of those particles not greater than 5..0 μm being 31% based on the number of particles and the proportion of those particles not smaller than 20 μm being 0% based on the volume of particles.

The resulting toner was evaluated in the same manner as in Example 13. The results obtained are shown in Table 5.

EXAMPLE 15

A magnetic toner was prepared from the following components in the same manner as in Example 12, except that 0.6% of hydrophobic colloidal silica and 0.5% of spherical silica powder having a particle size of 0.4 μm were externally added.

| | |
|---|---|
| Resin composition of Preparation Example 7 | 49.1% |
| Magnetic substance A | 30% |
| Magnetic substance D | 20% |
| Negative charge control agent (Spiron Black TRH) | 0.9% |

The resulting magnetic toner had a residual magnetization ($\sigma_r$) of 5.0 emu/g and a $D_{50}$ of 11.8 μm with the proportion of those particles not greater than 5.0 μm being 19% based on the number of particles and the proportion of those particles not smaller than 20 μm being 0.5% based on the volume of particles, in which the polyolefin particles had a mean dispersed particle size of 0.21 μm at a coefficient of size variation of 27% with the proportion of coarse particles of 2 μm or greater being 0% based on the number of particles.

The resulting toner was evaluated in the same manner as in Example 12. The results obtained are shown in Table 5.

EXAMPLE 16

A magnetic toner was prepared from the following components in the same manner as in Example 7, except that 0.5% of hydrophobic colloidal silica and 0.2% of spherical silica powder having a particle size of 1.0 μm were externally added.

| | |
|---|---|
| Resin composition of Preparation Example 7 | 47.5% |
| Magnetic substance B | 50% |
| Positive charge control agent (Bontron P-51) | 2.5% |

The resulting magnetic toner had a residual magnetization ($\sigma_r$) of 5.7 emu/g and a $D_{50}$ of 10.5 μm with the proportion of those particles not greater than 5.0 μm being 15% based on the number of particles and the proportion of those particles not smaller than 20 μm being 0.2% based on the volume of particles, in which the polyolefin particles had a mean dispersed particle size of 0.22 μm at a coefficient of size variation of 31% with the proportion of coarse particles of 2 μm or greater being 0% based on the number of particles.

The resulting toner was evaluated in the same manner as in Example 12, except that the photoreceptor of the printer was replaced with an amorphous silicon photoreceptor and that conditions of charging, transfer and development were altered to those for a positively chargeable toner. The results obtained are shown in Table 5.

TABLE 5

| Example No. | Image and Fog Density in Initial Stage 30° C., 85% RH Image | Fog | 10° C., 15% RH Image | Fog | Image Density After Obtaining 5000 Prints 30° C., 85% RH | 10° C., 15% RH | Signal Intensity (%) | Smears | Reject Rate (%) | Blurs | Fixing Properties | Comets |
|---|---|---|---|---|---|---|---|---|---|---|---|---|
| Example 12 | 1.49 | 0 | 1.45 | 0 | 1.38 | 1.42 | 147 | B | 0.0 (A) | B | B | A |
| Example 13 | 1.40 | 0 | 1.42 | 0.7 | 1.31 | 1.40 | 152 | B | 0 (A) | C | B | A |
| Example 14 | 1.42 | 0 | 1.43 | 0 | 1.38 | 1.40 | 165 | B | 0.10 (A) | A | C | C |
| Example 15 | 1.43 | 0 | 1.44 | 0 | 1.42 | 1.43 | 167 | B | 0.09 (A) | A | B | A |
| Example 16 | 1.41 | 0 | 1.42 | 0 | 1.37 | 1.40 | 155 | B | 0 (A) | C | B | A |
| Compar. Example 5 | 1.30 | 1.2 | 1.35 | 2.6 | 0.9 | 1.00 | 135 | C | 1.9 (D) | B | C | B |

As described and demonstrated above, the magnetic toner according to the present invention exhibits excellent environmental stability, satisfactory fixing properties, and high magnetism and is less causative of contamination of a toner carrier. Therefore, the magnetic toner provides a toner image having a high image density and free from background stains or blurs at a high definition sufficient for development of a digital latent image. The magnetic toner image obtained can be correctly read with an MICR with a reduced reject rate in reading to a practically acceptable level. The toner image is hardly separated when repeatedly scratched with a magnetic head in an MICR system, causing no reduction in image quality, no smear or no foil contamination.

Accordingly, the magnetic toner of the present invention is particularly useful in an MICR system.

While the invention has been described in detail and with reference to specific examples thereof, it will be apparent to one skilled in the art that various changes and modifications can be made therein without departing from the spirit and scope thereof.

What is claimed is:

1. A magnetic toner comprising a binder resin, a magnetic substance, and polyolefin fine particles, wherein the content of the magnetic substance is from 20 to 80% by weight, the polyolefin fine particles have a mean dispersed particle diameter of from 0.01 to 0.5 μm, the content of the polyolefin fine particles is from 2 to 20% by weight, and the toner particles have a residual magnetization ($\sigma_r$) of from 4 to 7.0 emu/g.

2. A magnetic toner as claimed in claim 1, wherein said polyolefin fine particles are polyethylene fine particles.

3. A magnetic toner as claimed in claim 1, wherein said polyolefin fine particles have a coefficient of variation of dispersed particle diameter of from 20 to 40%.

4. A magnetic toner as claimed in claim 1, wherein said magnetic substance has a residual magnetization ($\sigma_r$m) of from 7 to 24 emu/g.

5. A magnetic toner as claimed in claim 1, wherein said magnetic substance is a heat-treated magnetic substance.

6. A magnetic toner as claimed in claim 1, wherein said toner particles have an average particle diameter $D_{50}$ of from 4 to 9 μm.

7. A magnetic toner as claimed in claim 1, wherein said toner particles have adhered on the surface thereof inorganic oxide fine particles having an average particle size of from 0.05 to 1.5 μm.

8. A magnetic toner as claimed in claim 7, wherein said inorganic oxide fine particles are titanium oxide fine particles.

9. A magnetic toner as claimed in claim 7, wherein said inorganic oxide fine particles are spherical silica particles.

10. A magnetic toner as claimed in claim 1, wherein said binder resin is a polyester resin.

11. A magnetic toner as claimed in claim 1, wherein said toner is negatively chargeable.

12. A process for producing a magnetic toner comprising the steps of:

preparing a binder resin having finely dispersed therein a sufficient amount of polyolefin fine particles so that the content of the polyolefin fine particles is from 2 to 20% by weight of the magnetic toner;

blending said binder resin with a sufficient amount of a magnetic powder by melt-kneading so that the content of the magnetic powder is from 20 to 80% by weight of the magnetic toner, the magnetic toner has a residual magnetization ($\sigma_r$) of from 4 to 7 emu/g, and the polyolefin fine particles have a mean dispersed particle diameter of from 0.01 to 0.5 μm; and grinding and classifying the resulting mixture.

13. A process as claimed in claim 12, wherein said binder resin is prepared in the presence of a graft or block copolymer comprising at least a polyolefin.

14. A process as claimed in claim 13, wherein said graft or block copolymer comprising at least a polyolefin is a copolymer obtained from at least one of the monomers constituting the binder resin and a polyolefin.

15. A process as claimed in claim 13, wherein the polyolefin constituting said graft or block copolymer and the polyolefin of said polyolefin fine particles are both polyethylene.

16. A magnetic toner comprising a binder resin having dispersed therein a magnetic substance and polyolefin fine particles, wherein the content of the magnetic substance is from 20 to 80% by weight based on the toner, the polyolefin fine particles have a mean dispersed particle diameter of from 0.01 to 0.5 μm, the content of the polyolefin fine particles is from 2 to 20% by weight based on the toner, the toner particles have a residual magnetization ($\sigma_r$) of from 4 to 7 emu/g, and said binder resin comprises a high-molecular weight component having a weight average molecular weight of from 80,000 to 3,000,000 and a low-molecular weight component having a weight average molecular weight of less than 20,000.

17. A magnetic toner as claimed in claim 16, wherein said binder resin has a number average molecular weight of from 2,000 to 30,000 and a weight average molecular weight of from 20,000 to 400,000.

18. A magnetic toner as claimed in claim 16, wherein said low-molecular weight component contains a graft or block copolymer.

19. A magnetic toner as claimed in claim 16, wherein said graft or block copolymer is a copolymer of said polyolefin and a vinyl monomer.

20. A magnetic toner as claimed in claim 16, wherein said graft or block copolymer is a copolymer of a polyolefin different from said polyolefin and a vinyl monomer.

* * * * *